United States Patent [19]

Meyer et al.

[11] Patent Number: 4,901,246

[45] Date of Patent: Feb. 13, 1990

[54] METHOD AND APPARATUS FOR CLEARING FAULTS AT WORK STATION OF A TEXTILE MACHINE

[75] Inventors: Urs Meyer, Niederglatt; Stefan Huppi, Baar, both of Switzerland

[73] Assignee: Rieter Machine Works, Ltd., Winterthur, Switzerland

[21] Appl. No.: 247,888

[22] Filed: Sep. 22, 1988

[30] Foreign Application Priority Data

Sep. 24, 1987 [CH] Switzerland ..... 03724/87

[51] Int. Cl.[4] ..... G05B 19/00

[52] U.S. Cl. ..... 364/513; 364/468; 318/568.12

[58] Field of Search ..... 364/468, 513; 318/587, 318/568.12; 901/8

[56] References Cited

U.S. PATENT DOCUMENTS

| | | | |
|---|---|---|---|
| 4,664,590 | 5/1987 | Maekawa | 364/513 |
| 4,698,629 | 10/1987 | Mori et al. | 364/513 |
| 4,698,766 | 10/1987 | Entwistle et al. | 364/513 |

*Primary Examiner*—Allen MacDonald

[57] ABSTRACT

Identical robots are disposed on a common track along a textile machine having a plurality of spinning stations. The robots are controlled by a central control unit so as to be allocated to a respective sub-section of the track with each sub-section comprising the same number of faults which require clearing. The allocation of the robots to the respective sub-sections is performed periodically so as to optimize the operation of each robot for fault clearing purposes.

16 Claims, 3 Drawing Sheets

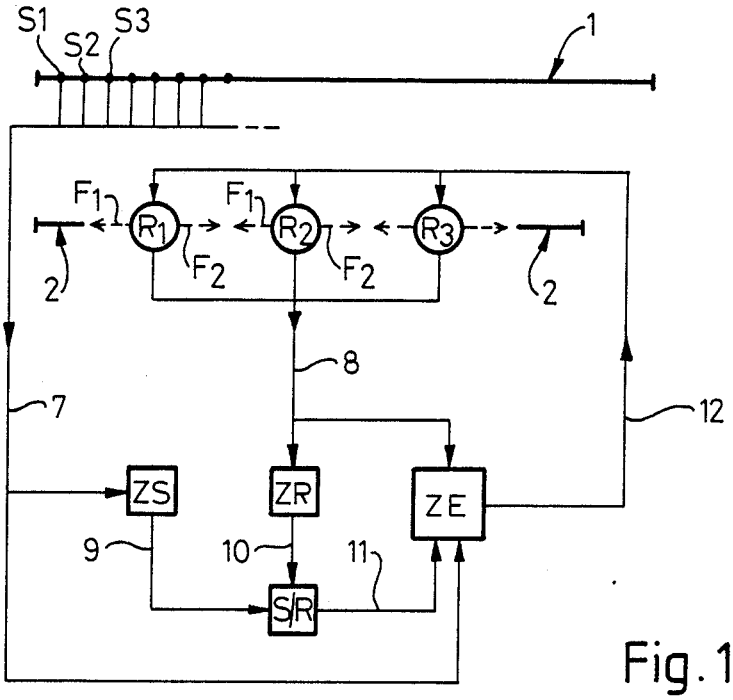
Fig. 1
Fig. 2
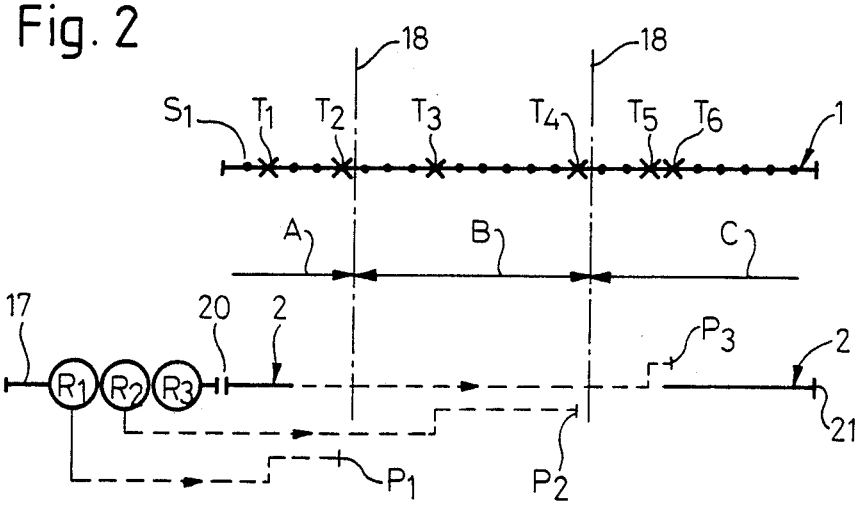

METHOD AND APPARATUS FOR CLEARING FAULTS AT WORK STATION OF A TEXTILE MACHINE

This invention relates to a method and apparatus of clearing faults at work stations of a textile machine.

Heretofore, various types of methods and apparati have been known for the clearing of faults at the work stations of a textile machine. For example, it has been know to use robots which are able to scan the work stations of a textile machine in order to detect the existence of a fault and to clear a fault at the detected station. However, the time taken to scan a large number of properly operating work stations means that less time is available for the actual work of fault clearance. Robots have also been known which respond to a fault indication from a work station such as a spinning station by moving directly to the nearest faulty station. However, in this case, two adjacent stations may continuously indicate a fault in a consecutive manner so that the robot shuttles between the two stations and, thus, has no capacity left to deal with other spinning stations requiring attention.

As is known, when two robots are used on the same rail or track, coordination problems have to be overcome if the robots are not to impede one another and if their working capacity is not be to distributed unevenly. For example, DE-AS No. 2,736,849 suggests reversing the direction of travel of two robots which come together while DE-OS No. 3,039,932 suggests maintaining the required distance between two robots by stopping one of them. FR No. 05 2,396,107 suggests creating a distance between the two robots by breaking off the operation of the caught-up robot.

When three or more robots are used, the problems of coordination become more acute since endeavors must be made to ensure that the robots are not trapped by their neighboring robots. Further, when robots having different functions are disposed on the rail, the work to be performed must be arranged in the correct sequence. This leads to additional outlays in terms of controls. To compensate for different job times, for example, the speeds of travel of robots doing different jobs must also differ from one another, and elaborate action is necessary to achieve this.

The idea is gaining ground of using not a fixed association between one or more robots and a single textile machine but more flexible systems wherein a number of robots serve a number of textile machines so that free capacity of any robot at any machine can be used at some other machine. DE-OS No. 2,460,375 describes such a system wherein a rail network so extends around two rows of textile machines that a number of robots move continuously on a closed stand-by track between the two rows of machines. In this case, the robots respond to faults by being deflected by way of switches or points onto circular or loop work tracks along the spinning stations of the machine. TO this end, each station has a yarn monitor which responds to a fault by transmitting a corresponding signal to a central control unit by way of a combined transmitter associated with the machine. The unit opens the corresponding switch in the rail network and directs a robot onto the work track of the machine reporting a fault. Having arrived at the faulty machine, the robot test all the spinning stations stepwise and the work track is closed to other robots to avoid collisions. However, in this arrangements, the robot may waste too much time in doing checking work and, just because of one spinning station needing servicing, is for some considerable time unavailable for necessary work on other machines.

Accordingly, it is an object of the invention to optimize the capacities of the robots used for clearing faults in the work stations of a textile machine.

It is another object of the invention to fully and economically utilize the work capacity of robots used for clearing faults in a textile machine having a plurality of work stations.

Briefly, the invention provides a method of clearing faults at fault-reporting work stations of at least one textile machine with the assistance of at least two centrally controlled robots which are movable along a track alongside the machine. In accordance with the method, the position and number of faulty work stations is first determined along with the position and number of robots for clearing the faulty work stations. In general, a faulty station is a station requiring the attention of a robot. Next, the number of faulty work stations to be cleared are uniformly distributed to the robots numerically while respective sub-sections of the track are allocated to each robot. Thereafter, the robots are directed to the respective allocated sub-section and the faulty work stations of each sub-section are cleared solely by the robot allocated to the sub-section. Since the robots are directed to the respective sub-sections of the track, the robots automatically remain physically separated from one another. Hence, no elaborate precautions against possible collisions are required.

Allocating the same number of faulty work stations to each robot ensures that all the robots are continually in useful service. Further, since the robots are directed straight to the faults, checking and inspection times are eliminated.

In accordance with the method, the determination of faulty work stations and robots is repeated after a predetermined time interval. Thus, a new division of the subsections is not continually changed so that travel movements for changing sections are limited.

The robots are moved in the same direction on their way to the allocated sub-sections and the faulty stations nearest the same end of the sub-section are cleared first. This provides an additional assurance that between-robot distances are observed. This consideration becomes particularly important in the case of faulty stations requiring clearance near the common ends of the sub-sections.

After completing fault clearance work, each robot is stopped and remains stationary until a faulty station reported in the associated sub-section of the track has to be cleared. This ensures that the stand-by positions of the robots are conveniently staggered or spaced apart even after the tasks of fault clearing have been performed. An additional advantage resides in that the robots are distributed substantially uniformly over the whole length of the movement path or track. Hence, starting times to new zones of use or sub-sections remain short.

During operation, the robots may be moved at the same speed. This is advantageous since the robot drives of each robot may be made similar or uniform, a feature which aids in keeping costs low.

In order to avoid overloading of robot capacity, and thus a drop in the efficiency of the machines to be serviced, an additional robot may be brought into operation in response to a predetermined number of faulty stations being determined. Thus, optimum fault clearance in a complete textile machinery plant can now be provided with a very reduced number of robots. In this respect, new divisions adapt the sub-sections of the track to locally changing work requirements.

The faults at each work station are detected individually in numerical form. Further, a signal indicative of a continuous fault may be omitted in response to an accumulation of faults at a respective work station within a predetermined period of time, so as to avoid having a robot clear a fault at the work station. In this case, a continuous fault would not be dealt with by a robot so that the demand on the robot capacity is reduced. Conveniently, a supervisor should look for the cause of a continuous fault.

The invention further provides an apparatus which is utilized with at least one textile machine having a plurality of work stations, a track disposed along the work stations and at least two robots for clearing faults at the work stations which are movable along the track. In addition, a plurality of stationary yarn monitors are provided with at least one monitor being disposed at a respective work station to emit a fault signal indicative of a fault thereat.

In accordance with the invention, a central control unit is provided for receiving fault signals from the yarn monitors within a set time period. In addition, a first counter is provided for receiving and counting the number of fault signals emitted from the monitors in the set time period while a second counter is provided for counting the number of robots in operation for clearing faults at the work stations during the set time period. Still further, a division module is connected to the two counters to receive signals therefrom indicative of the number of fault signals and the number of robots in operation for the set time period. This module is also connected to the central control unit for delivering a signal thereto corresponding to the number of faults per robot to be corrected. Still further, the central control unit is connected to the robots to direct each robot to a predetermined sub-section of the track for clearing of the faults in the sub-section in response to the signal from the divisional module whereby the same number of faulty stations appear in each sub-section.

The apparatus is such that the track for the robots does not require any switches and does not require any expensive anti-collision interlocks. The track on which the robots move may be linear or endless. In the case of an endless track the robots may be movable in only one direction so as to provide additional economic benefits. Still further, the track may be of an undulating type to extend about different textile machines while having two terminal ends.

These and other objects and advantages of the invention will become more apparent from the following detailed description taken in conjunction with the accompanying drawings wherein:

FIG. 1 illustrates a diagram of an apparatus constructed in accordance with the invention;

FIG. 2 schematically illustrates one embodiment of an apparatus constructed in accordance with the invention;

FIG. 3*a* illustrates the positions of three robots relative to a textile machine before a set time interval in accordance with the invention;

FIG. 3*b* illustrates a view similar to FIG. 3*a* of three robots after a set time period has expired in accordance with the invention;

Figure 3A:
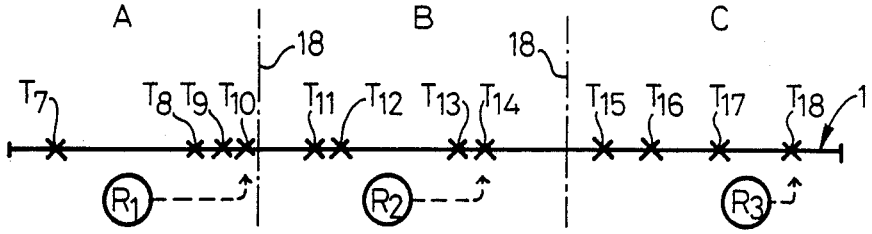

Referring to FIG. 1, a textile machine such as a ring spinning machine 1 having a plurality of work stations, such as spinning stations, S1, S2, S3 ... has a track 2 disposed along the stations on which a plurality of robots, for example, three robots R1, R2, R3, are movable to the left in the direction indicated by the arrow F1 and to the right as indicated by the arrow F2.

The robots are identical to each other and are of the multi-purpose kind. That is, each robot may perform all of the necessary jobs at a spinning station such as piecing-up, laying in sliver, clearing coiling, and the like. These robots may move either on ground rails or by way of support rails secured to the machine or on the ground with automatic guidance.

Each spinning station S1, S2, S3 ... is associated with a stationary fault-transmitting yarn monitor or sensor. Each monitor is disposed at a respective station to emit a fault signal indicative of a fault therein. In addition, the monitors communicate by way of a reporting line 7 with a central control unit or computer ZE as well as with a counter ZS.

The central control unit ZE receives the fault signals from the yarn monitors via the reporting line 7 within a set time period as further explained below. The counter ZS receives and counts the number of fault signals emitted from the monitors via the line 7 in the set time period.

All of the robots R1, R2, R3 are connected via a reporting line 8 with the central control unit ZE and with a second counter ZR which serves to count the number of robots in operation for clearing faults at the work stations during the set time period.

A division module S/R is connected to the counters ZS, ZR, via connecting line 9, 10 in order to receive signals therefrom indicative of the number of faulty stations and the number of robots in operation for the set time period, thus determining the number of faulty stations per robot. The module S/R is connected via a line 11 to the central control unit ZE in order to deliver a corresponding signal.

The central control unit is adapted to detect and evaluate the faulty stations and the in-use robots numerically and by position in order to determine the sub-sections of the track for each robot and to direct the robots to the respective sub-sections by way of a control line 12. For example, as indicated in FIG. 2, where six faulty stations T1, T2 . . . T6 have been indicated, three sub-sections A, B, C are determined for the three robots with each section having two faulty stations allocated thereto, irrespective of whether the faults are present in just a single machine or in a number of machines.

The central control unit ZE then transmits instruction signals by way of the control line 12 to each of the robots to ensure that the robots do not impede one another or are in one another's way as they travel to the respective sub-sections. That is, the robot R3 first receives the movement instruction and is sent to sub-section C. Thereafter, the robot R2 is directed to sub-section B whereafter the robot R1 is directed to the sub-section A.

Of note, the counters ZS, ZR, division module S/R and central control unit ZE each represent known electronic functions and need not be further described as each can be embodied as a printed circuit board or as an integrated circuit or as a program module for a microprocessor.

Referring to FIG. 2, the robots R1, R2, R3 are initially disposed on a siding or station 17, for example, when the textile plant is initially taken into operation. The faulty stations T1 . . . T6 are each marked with a cross on the line indicating the textile machine 1. As already described, the central control unit ZE determines the sub-sections A, B, C which are separated from each other by a chain-dotted line 18. The robots are then moved to the respective sub-section as noted above with all of the robots moving the same direction to the right and all of the robots initially attending to the fault, i.e., the faulty station, nearest the same end of the subs-section in each case. In this case, each end is the left-hand end of a respective sub-section A, B, C. Accordingly, the robot R3 first clears the fault at the faulty station T5, then moves on to faulty station T6. In the absence of any further fault reports, the robot R3 remains in position P3—i.e., the position opposite the cleared station T6. Similarly, the robot R2 first clears the faulty station T3 and after clearing faulty station T4 remains in position P1. The robot R1 first clears the fault at station T1, then moves on and clears the fault at station T2 and stops in the position P1 opposite the cleared station T2.

Figure 3B:
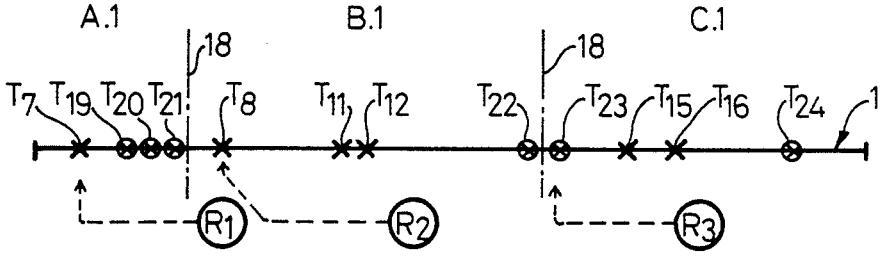

FIG. 3*a* shows a different situation in which the robots R1, R2, R3 have stopped at random along the track 2 (not shown for the sake of clarity). For example, twelve faults are then reported at stations T7–T18. After detection of the sub-sections A, B, C, the robots are instructed to move to the faulty station nearest the chain-dotted boundary line 18. In the case shown in FIG. 3*a*, all the robots move to the right. However, they could all move to the left. The appropriate direction of travel is determined by the central control unit ZE and depends upon the distance which the robots have to travel. After a predetermined time interval, the unit ZE redetermines the sections A, B, C. Until this redetermination occurs the robot R1 clears stations T10 and T9 consecutively and is just in the vicinity of station T8. The robot R2 clears the stations T14 and T13 and moves to station T12. The robot R3 clears the stations T18, T17. Consequently, the robots are positioned as shown in FIG. 3*b* at the expiration of the set time period when the sub-sections A, B, C are then redetermined. During this new time interval, six new faulty stations T19 to T24, each denotes by a ringed cross, have been reported to the unit ZE. The new division of the sections A1, B1, C1 is such that each new sub-section contains the same number of faulty stations or faults. The robots R1, R2, R3 are now all instructed to move to the left and, bypassing the faulty stations T19–T21, T11, T12 and T15, T16 respectively, to attend to whichever faulty station is nearest the end of the particular sub-secton concerned. In the case shown in FIG. 3*b*, the corresponding stations are T7, T8 and T23 respectively. Here too the faulty stations T21, T22, and T24 respectively could be attended to. Since the robots all move at the same speed and also have the same number of faulty stations to clear, there is no possibility of a collision with other robots.

Should it be found that the robots R1, R2, R3 in operation are insufficient to clear the faults within a useful time, new robots can be received into the system or brought into operation from the siding 27 (FIG. 2).

The central control unit ZE provides numerical detection of the faults of each spinning station. Should it be found that the accumulation of faults within a predetermined period of time for a given station exceeds a predetermined value, the spinning station concerned ceases to be serviced by the robot and the central control unit ZE merely indicates the station concerned on the control console, whereafter a supervisor can inspect the faulty station concerned.

Figure 4:
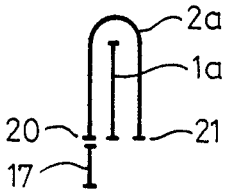
FIG. 4 illustrates a linear track disposed about a single textile machine in accordance with the invention.

Referring to FIG. 4, the track on which the robots travel may be a linear track 2*a* which extends in a U around a textile machine.

Figure 5:
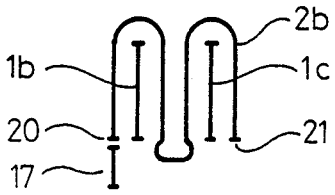
FIG. 5 illustrates a linear track disposed about two textile machines in accordance with the invention.

FIG. 5 shows another embodiment of a linear track which extends on both sides of two textile machines 1*b* and 1*c*. The two tracks 2*a*, 2*b* have no branches and have two ends 20, 21 each. The siding 17 is connected to the end 20.

Figure 6:
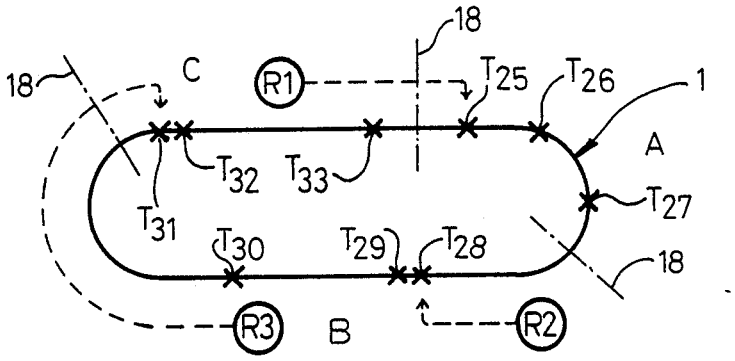
FIG. 6 illustrates further embodiment employing an endless track for three robots in accordance with the invention.

FIG. 6 shows faulty stations on the line 1 which, as previously stated, represents one or more textile machines, the robots R1, R2, R3 being adapted to travel merely in one direction on an endless linear closed track 2 (not shown for the sake of clarity). In this case, the robots first attend to the faulty stations at which the robots arrive immediately after the chain-dotted boundary line 18 as considered in the direction of travel. Assuming that the unit ZE, with the robots in the position shown, determines the sub-sections A, B, C as shown, such sections being separated by the chain-dotted boundary lines 18, and that the robot R1 is allotted sub-section section A, the robot R2 sub-section B and the robot R3 sub-section C, all the robots move clockwise to the right as indicated by the chain lines. Accordingly, the robot R1 first clears the station T25—i.e., the faulty station nearest the left-hand end of the section A—bypassing the faulty station T33 which is disposed before the robot R1 as considered in the direction of movement. In accordance with the same instruction of the unit ZE, the robot R2 first attends to the faulty station T28 and the robot R3 the faulty station T31. Upon completion of the servicing or clearing work and assuming that no further faulty stations are reported, the robot R1 is situated opposite the station T27, the robot R2 opposite the station T30 and the robot R3 opposite the station T33. Clearly, the between-robot distance both in the initial position shown in FIG. 6 and in the end position after clearance of the faulty stations T27, T30, T33 remains substantially the same.

Figure 7:
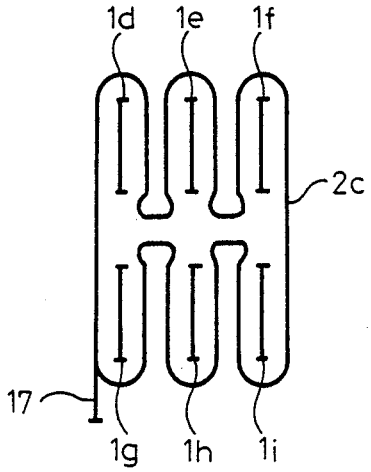
FIG. 7 illustrates a further endless track disposed in undulating fashion about a plurality of textile machines in accordance with the invention.

FIG. 7 shows an advantageous endless linear track 2*c* which loops around parallel-disposed textile machines 1*d*–1*i* so that no substantial parts of the track are out of range of the spinning stations. An endless linear track which loops around textile machines arranged in a star is also possible. The track arrangement 2*c* has no branches, junctions or switches except for a siding 17 necessary for supplying spare robots.

The invention thus provides a method and apparatus which can be used for all appropriate textile machines but which is particularly advantageous for ring spinning machines.

Further, the invention provides a method and apparatus for clearing faults at fault-reporting work stations of a textile machine in an economical manner, making particularly economical use of the robots for clearing the faults at the various work stations.

The invention further provides a system wherein the time of operation of a robot can be optimized for fault-clearing purposes while minimizing the time required for detecting a faulty station.

What is claimed is:

1. A method of clearing faults at fault-reporting work stations of at least one textile machine with the assistance of at least two centrally controlled robots movable along a track alongside the machine, said method comprising the steps of determining the position and number of faulty work stations;

determining the position and number of robots for clearing the faulty work stations;

uniformly distributing the number of faulty work stations to be cleared to the robots numerically;

allocating a respective sub-section of the track to each robot;

thereafter directing each robot to a respective allocated sub-section; and clearing the faulty work stations of each sub-section solely by the robot allocated to said sub-section.

2. A method as set forth in claim 1 wherein the determination of faulty stations and robots is repeated after a predetermined time interval.

3. A method as set forth in claim 1 wherein the robots move in the same direction on their way to the allocated sub-sections and the faulty stations nearest the same end of the sub-section are cleared first.

4. A method as set forth in claim 1 wherein the robots are stopped after completing their fault clearance work.

5. A method as set forth in claim 1 wherein the robots all move at the same speed.

6. A method as set forth in claim 1 which further comprises the step of bringing an additional robot into operation in response to a predetermined number of faulty stations being determined.

7. A method as set forth in claim 1 wherein faults at each work station are detected individually in numerical form and which further comprises the step of emitting a signal indicative of a continuous fault in response to an accumulation of faults at a respective work station within a predetermined period of time without clearing of said faults.

8. A method of clearing faults at fault-reporting work stations of a textile machine with the use of fault-clearing robots comprising determining the position and number of faulty work stations at the beginning of a set time period;

determining the number of robots for clearing the faulty stations;

uniformly assigning the faulty stations to be cleared to the robots numerically while allocating each robot to a respective sub-section of a common track along the work stations;

thereafter moving each robot to the respective allocated sub-section; and clearing the faulty stations in each sub-section by the robot allocated to said sub-section during the remainder of said set time period.

9. A method as set forth in claim 8 wherein said steps are repeated at least once after said set time period.

10. A method as set forth in claim 8 wherein the robots are moved in the same direction during travel to said allocated sub-sections.

11. A method as set forth in claim 8 wherein each robot is maintained in a stationary position in an allocated sub-section after clearing the faulty stations therein during said set time period.

12. In combination at least one textile machine having a plurality of work stations, a track disposed along said work stations and at least two robots for clearing faults at said work stations movable along said track;

a plurality of stationary yarn monitors, at least one of said monitors being disposed at a respective work station to emit a fault signal indicative of a fault thereat;

a central control unit for receiving fault signals from said yarn monitors within a set time period;

a first counter for receiving and counting the number of fault signals emitted from said monitors in said set time period;

a second counter for counting the number of robots in operation for clearing faults at said work stations during said set time period;

a division module connected to said counters to receive signals therefrom indicative of the number of faulty signals and the number of robots in operation for said set time period, said module being connected to said central control unit to deliver a signal thereto corresponding to the number of faulty signals per robot to be corrected;

said central control unit being connected to said robots to direct each robot to a predetermined sub-section of said track for clearing of the faults in said sub-section in response to said signal from said division module whereby the same number of faulty stations appear in each sub-section.

13. The combination as set forth in claim 12 wherein said track is linear.

14. The combination as set forth in claim 12 wherein said track is an endless track.

15. The combination as set forth in claim 14 wherein said robots are movable in only one direction on said endless track.

16. The combination as set forth in claim 12 wherein said track is an undulating track having two terminal ends.

* * * * *

UNITED STATES PATENT AND TRADEMARK OFFICE

CERTIFICATE OF CORRECTION

PATENT NO. : 4,901,246

DATED : February 13, 1990

INVENTOR(S) : URS MEYER, et al

It is certified that error appears in the above-identified patent and that said Letters Patent is hereby corrected as shown below:

Column 1, line 11 "know" should be -known-
Column 1, line 66 "test" should be -tests-
Column 1, line 68 "arrangements" should be -arrangement-
Column 5, line 54 "denotes" should be -denoted-

Signed and Sealed this

Seventh Day of May, 1991

*Attest:*

HARRY F. MANBECK, JR.

*Attesting Officer*

*Commissioner of Patents and Trademarks*